US005226342A

United States Patent [19]

Panin

[11] Patent Number: 5,226,342

[45] Date of Patent: Jul. 13, 1993

[54] LINEAR OR CIRCULAR RACHET-TYPE LOCKING DEVICE WITH AUTOMATIC UNLOCKING AND SELF-LOCKING

[75] Inventor: Fabio Panin, Valkenburg, Netherlands

[73] Assignee: Agence Spatiale Europeenne, Paris, France

[21] Appl. No.: 730,834

[22] PCT Filed: Jan. 24, 1990

[86] PCT No.: PCT/FR90/00052

§ 371 Date: Jul. 5, 1991

§ 102(e) Date: Jul. 5, 1991

[87] PCT Pub. No.: WO90/09628

PCT Pub. Date: Aug. 23, 1990

[30] Foreign Application Priority Data

Feb. 7, 1989 [FR] France ..... 89 01529

[51] Int. Cl.[5] ..... G05G 5/06

[52] U.S. Cl. ..... 74/575; 74/577 R; 74/577 M; 74/578; 188/82.2; 188/82.7

[58] Field of Search ..... 74/575, 577 R, 577 M, 74/578; 188/82.2, 82.7

[56] References Cited

U.S. PATENT DOCUMENTS

| | | | |
|---|---|---|---|
| 41,574 | 2/1864 | Groel | 74/577 M X |
| 275,657 | 4/1883 | How | 74/577 M X |
| 839,957 | 1/1907 | Reiss | 74/577 M X |
| 1,140,167 | 5/1915 | Kolb et al. | 74/577 M X |
| 1,824,515 | 9/1931 | Traphagen | 74/538 |
| 2,871,719 | 2/1959 | Hooker | 74/503 |
| 3,590,656 | 7/1971 | Lloyd | 74/575 |
| 4,468,005 | 8/1984 | Nakamura | 74/577 M X |

FOREIGN PATENT DOCUMENTS

| | | | |
|---|---|---|---|
| 586210 | 10/1933 | Fed. Rep. of Germany . | |
| 618309 | 8/1978 | U.S.S.R. | 74/577 R |

*Primary Examiner*—Allan D. Herrmann
*Assistant Examiner*—William O. Trousdell
*Attorney, Agent, or Firm*—Bell, Seltzer, Park & Gibson

[57] ABSTRACT

The locking device (100) includes a pivoting ratchete (10) and a component (30) that is movable between two extreme stop positions. The pivoting ratchet (10) is symmetrical about a plane including its pivot axis (35), and it includes first and second locking fingers (15, 25) each of which is designed to engage in stable manner and under the action of a load (F) acting on the moving component (30) in a corresponding one of symmetrical notches (50*a*, 50*b*) formed in the moving component. A spring (20) is mounted in a prestressed state so that for a given resilient reaction (R1) thereof, the distance of said reaction from the pivot axis (35) of the ratchet (10) in either of the two stable locking positions is such that the ratchet (10) is unlocked by applying the smallest load that is likely to be applied to the moving component (30) in the direction that tends to switch it from one extreme stop position to the other. The device is applicable in space, in particular for telescopes and solar cell panels, and for docking devices, it also has Earth applications, in particular for special screwdrivers, for automatic tool dispensers, for detecting positions, or for detecting reversal of motion.

7 Claims, 8 Drawing Sheets

LINEAR OR CIRCULAR RACHET-TYPE LOCKING DEVICE WITH AUTOMATIC UNLOCKING AND SELF-LOCKING

The present invention relates to a locking device of the rachet-type capable of limiting the movement of a moving component between two extreme stop positions.

Various ratchet locking devices are known. Two conventional types are shown in FIGS. 1 and 2. The moving component of the device shown in FIG. 1 is constituted by a rack comprising a uniform succession of triangular-shaped notches on one side which are disposed so that together they define a saw-tooth profile. The means for locking the above rack is constituted by a sharp finger for engaging in one of the notches of the rack under drive acting in the direction of the arrow shown in FIG. 1. The finger is held in its locking position by a spring mounted in a prestressed condition to urge the finger against the bottom of the triangular profile of a notch. Passage from one tooth to the next takes place suddenly after the locking finger has slid over the sloping side of the preceding notch. Travelling from the first notch to the last notch defines the maximum stroke of the rack in the above-defined direction. In this case, it is clear that in order to return to the initial position, it is necessary to apply external action to the device so as to disengage the locking finger from the last notch and to slide the rack so as to bring the first notch into coincidence with the locking finger.

As for the device shown in FIG. 2, the moving component thereof comprises a special type of rack which is provided with a succession of notches on one side having the shape of circular arcs (which are slightly smaller than the corresponding semi-circumference), which notches are uniformly spaced apart along one side of the rack. The locking means for the rack is constituted by a ball for resiliently engaging in a notch and remaining therein under drive from a spring, which spring is likewise prestressed, with the ball remaining in a notch until a force is applied in either direction as shown by the double-headed arrow of FIG. 2.

The locking device shown in FIG. 1 is of the "one-way" type whereas the locking device of FIG. 2 is of the "two-way" type for which the direction of motion of the rack is reversed automatically at the end of its stroke without requiring the locking means to be deactivated. However, the FIG. 2 device suffers from the drawback that the load which may be applied thereto is limited because it is difficult to actuate the rack if the prestress of the spring is too high.

An object of the present invention it thus to provide a two-directional type ratchet locking device capable of limiting the motion of a moving component between two extreme stop positions in which the load that can be applied is not limited by the prestress of the spring acting on the locking means (ratchet) and in which it is therefore easy to put the moving component into action, i.e. the motion of the moving component reverses automatically without there being any need to unlock the ratchet to allow the moving component to go to its opposite extreme stop position when the direction of application of the applied load reverses: in the context of the present invention this condition is expressed by saying that the device is an "automatically-unlocking" device (with the ratchet naturally being unlocked); which device should also be capable of detecting intermediate positions between the two extreme stop positions through which the moving component passes, with such detection having no effect on the motion of said moving component and being independent of its direction of movement; and, naturally, it should require no external action to activate locking of the moving component when it reaches one of its extreme stop positions (i.e. the device is self-locking).

The present invention provides a moving component for moving between first and second extreme stop positions, and including at least a first notch and a second notch formed in the moving component symmetrically about an axis of symmetry thereof and in positions corresponding to its extreme stop positions, with the bottoms of said notches having sections of appropriate profile;

a ratchet pivoting between a first stable equlibrium position and a second stable equilibrium position, which positions correspond to locking the moving component in its above-mentioned first and second stop positions respectively, which pivoting ratchet is symmetrical about a plane including its pivot axis and including on opposite sides of said plane a first locking finger and a second locking finger each for engaging in stable manner under the action of a load acting on the moving component in a corresponding one of the notches formed in the moving component, in correspondence with said extreme stop positions, and until a load is applied to the moving component in the opposite direction (naturally, the two locking fingers of the ratchet are likewise symmetrical about the above-mentioned plane of symmetry); and a spring mounted in a prestressed condition so that its resilient reaction establishes a moment about the pivot axis of the ratchet, which moment acts in such a direction as to maintain said ratchet in its first or second stable equilibrium position, thereby locking the moving component in its first or second extreme stop position, respectively, the spring being mounted in such a manner that for a given resilient reaction thereof, the distance of said reaction relative to the pivot axis of the ratchet in either of the two locking positions is such that the ratchet is unlocked by the application of the smallest load that may be applied to the moving component in the direction for moving towards the other extreme stop position, such a ratchet-unlocking load causing the ratchet to pivot towards a "switchover" position in which the moment of its resilient reaction relative to the pivot axis of the ratchet becomes zero such that final switching over thereof to the other locking position for locking the moving component in said other extreme stop position takes place automatically solely under drive from the above-mentioned ratchet-unlocking load.

In addition to the above dispositions, the invention includes other dispositions which appear from the following description.

The invention will be better understood from the following additional description given with reference to the accompanying drawings, in which:

FIG. 1 shows a conventional rectilinear type one-way ratchet locking device, whereas

Figure 1:
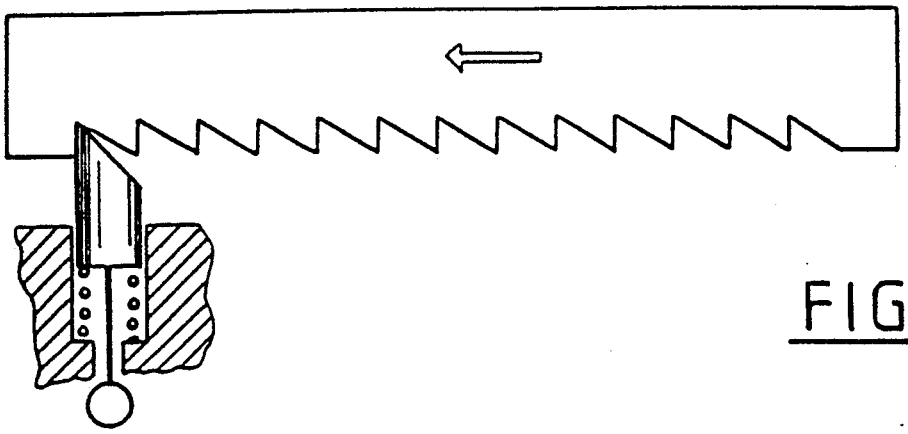
Figure 2:
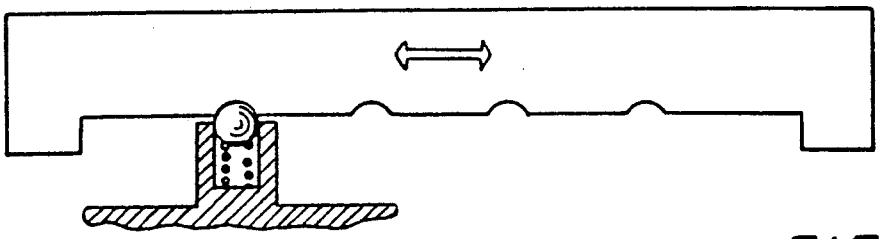
FIG. 2 shows a two-way locking device which is likewise of a conventional rectilinear type; these two figures are described in the portion of the preamble relating to the prior art.
Figure 3:
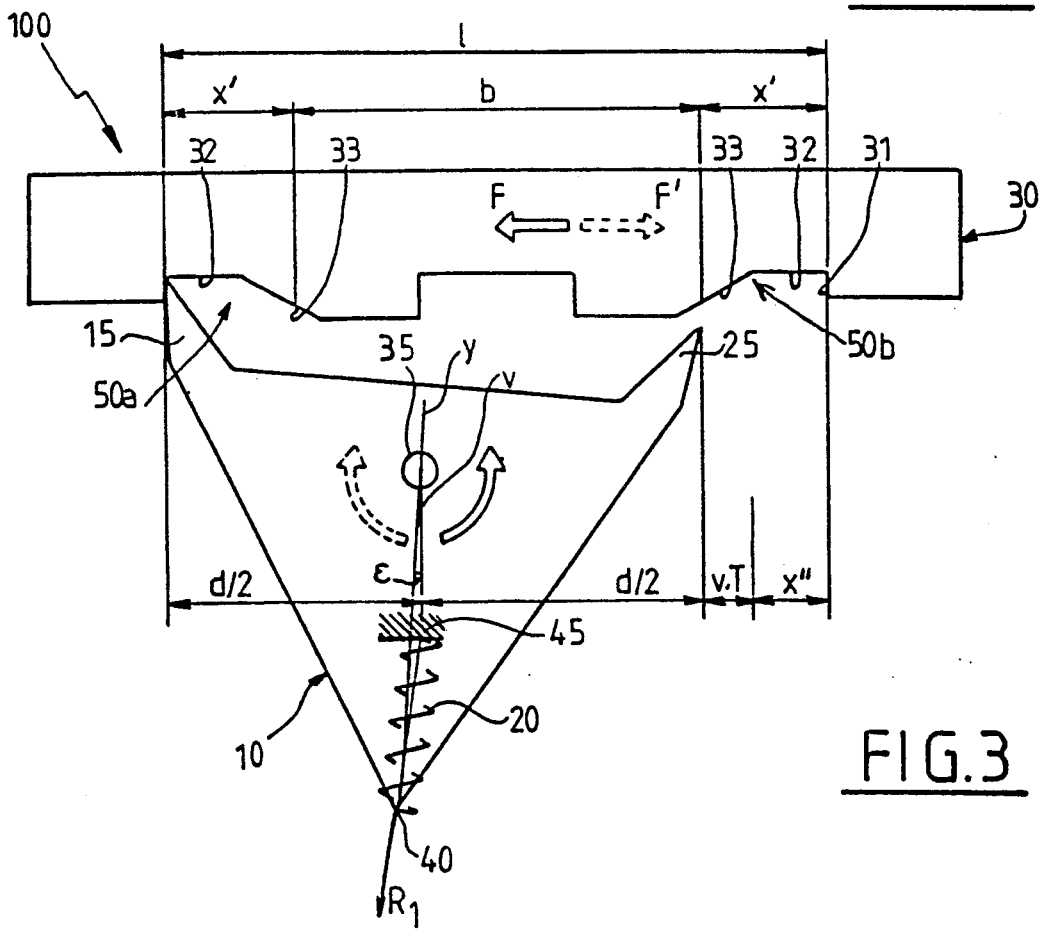
FIG. 3 shows a first two-directional ratchet locking device of the present invention and of the rectilinear type.
Figure 6:
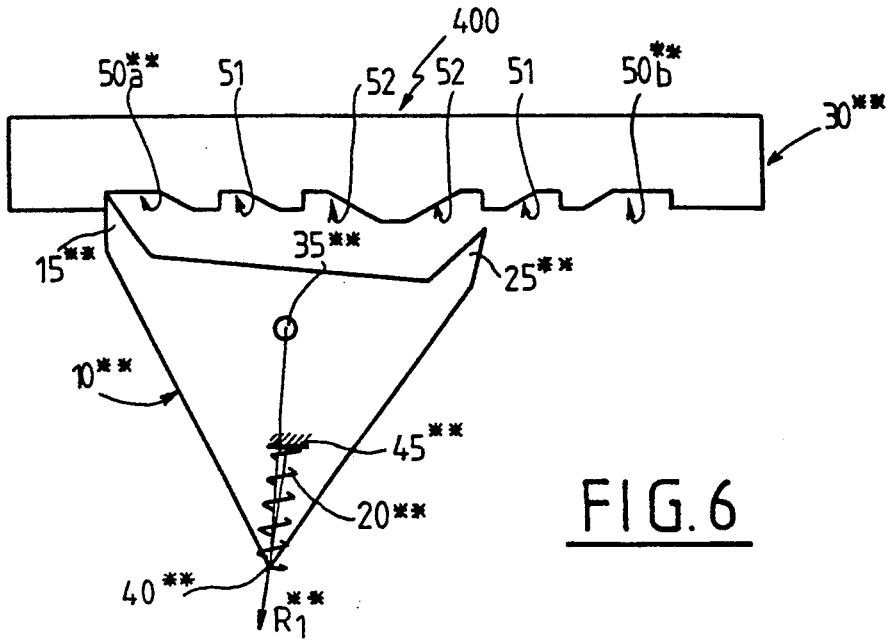
Figure 5:
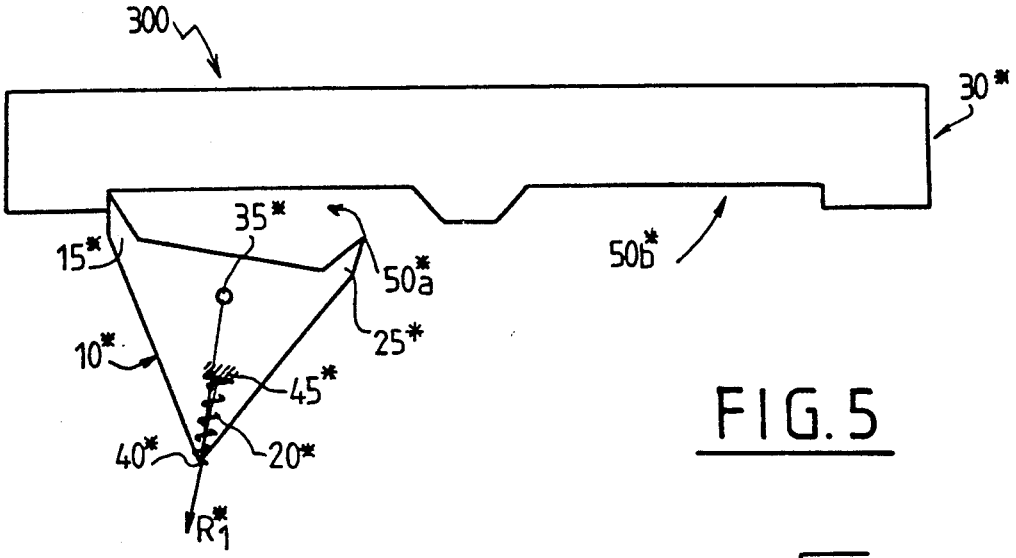
Figure 13:
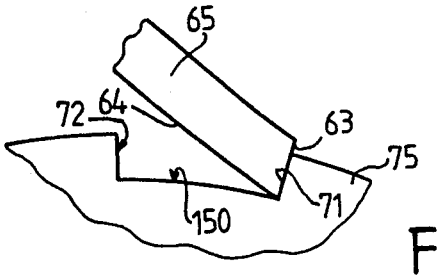
Figure 14:
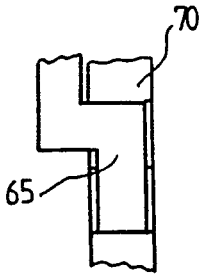
Figure 12:
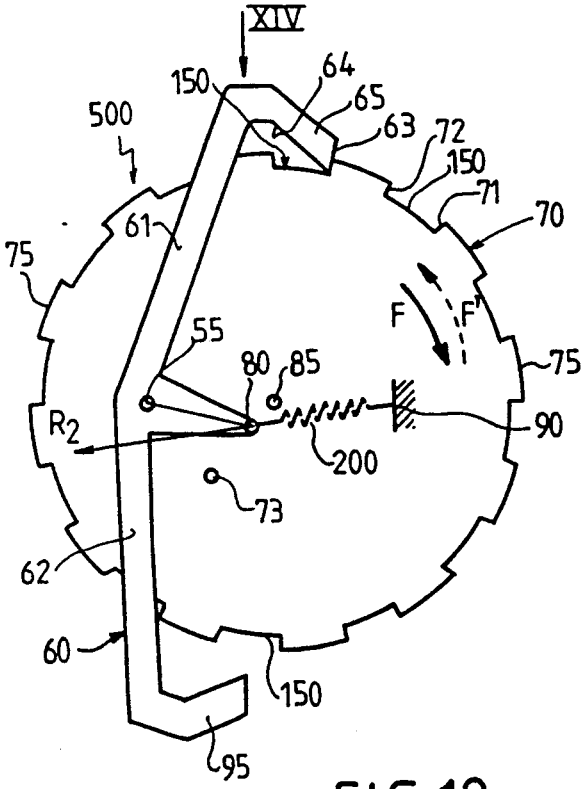
Figure 15:
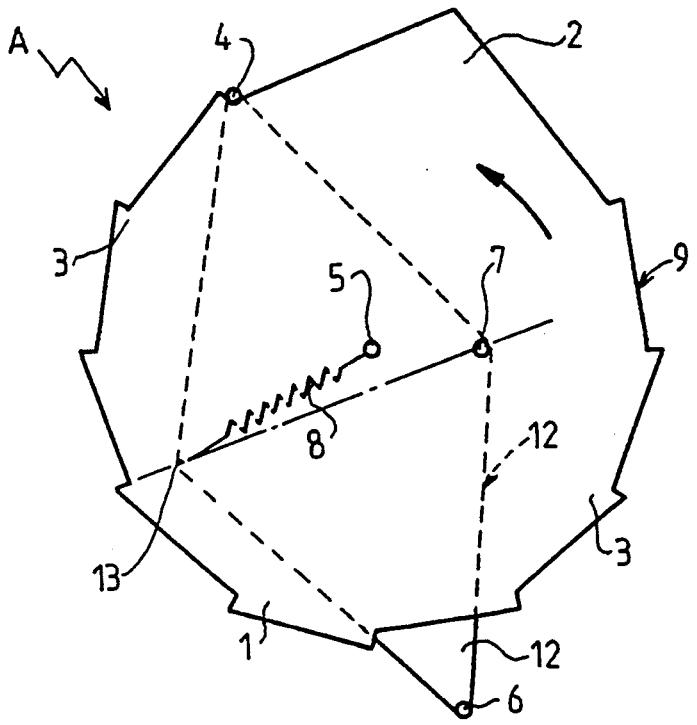
Figure 16:
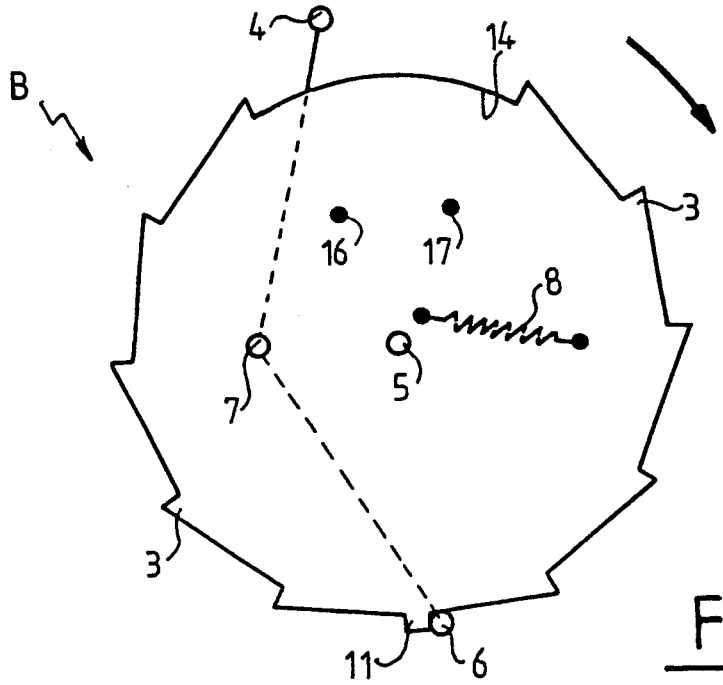
Figure 17:
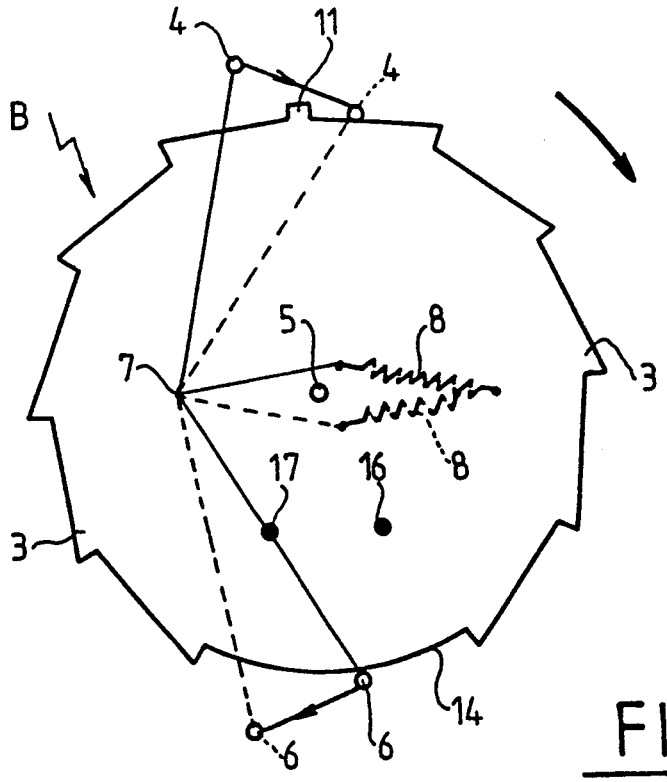

FIG. 4 shows various positions in the sequence of movements whereby the moving component of the device of FIG. 3 passes from its first extreme stop position to its second extreme stop position and, in particular, it shows the instant at which the ratchet switches over from its first locking position to its second locking position, while still being capable of sensing the direction in which the resilient force of the prestressed spring acts on the ratchet to hold locking in stable manner in one or other of these positions until a force is applied that displaces the moving component of the device to its second extreme stop position;

FIGS. 5 and 6 show two variant embodiments of the ratchet locking device shown in FIG. 3;

FIGS. 7 to 11 are various graphs showing how certain variables applicable to the device of the invention vary with respect to time;

FIG. 12 shows a second two-directional ratchet locking device applying the principle on which the present invention is based, this device being of the rotary type, with FIGS. 15 to 17 showing the thought process that led to the design illustrated in FIG. 12;

FIG. 13 shows a detail of the ratchet wheel belonging to the rotary ratchet locking device of FIG. 12;

FIG. 14 shows a detail view of the FIG. 12 device as seen on arrow XIV; and

Figure 18:
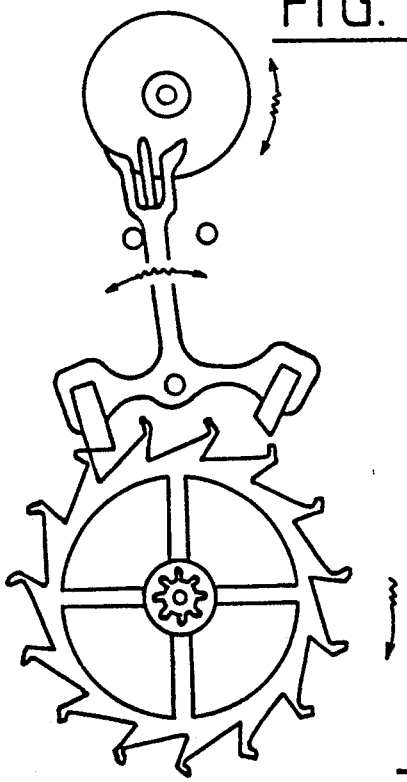

FIG. 18 shows a conventional escapement mechanism used in clocks and given essentially for the purposes of comparison with the device of the invention as shown in FIG. 12 and for the purpose of showing up the differences therebetween.

FIG. 3 is a diagram showing the principle on which the first ratchet locking device 100 of the invention is based. This device 100 comprises a moving component 30 defined by a rectilinear segment suitable of moving to left or to right depending on the direction of a force F which is applied thereto. This moving component 30 is capable of occupying two extreme positions, which are the only two stable equilibrium configurations of the device. Between its extreme positions, motion of the component 30 is limited by a "ratchet" type locking means 10 suitable for pivoting about a shaft 35 fixed to a support frame. FIG. 3 shows the moving component 30 locked in its first extreme stop position for rightwards motion by the ratchet 10 which is disposed in its first locking position, i.e. with its locking finger 15 engaged in a notch 50*a* formed in the edge of the moving component 30. Another notch 50*b* symmetrical to the notch 50*a* about a plane of symmetry of the moving component is provided at the other end of the moving component 30 and is intended to lock the moving component by engaging a finger 25 on the ratchet 10 and disposed symmetrically to the finger 15 thereof, with such locking occuring when the moving component moves leftwards. Each of the two notches 50*a* and 50*b* has a section with a special composite profile defined by a succession of three segments 31, 32, and 33, of which the first segment 31 is a vertical segment constituting an abutment against which the finger 15 of the locking ratchet comes into engagement, whereas the segment 32 is a horizontal segment, and is followed by the segment 33 which is a sloping segment.

The ratchet 10 is held in the locking position, and thus in its first stable equilibrium configuration, by means of a spring 20 which is mounted in a prestressed state between a point 40 on the ratchet 10 and a fixed point 45 of the frame (which frame is indicated highly diagrammatically in the drawing by a symbol normally used to represent ground). The direction of the resilient reaction R1 of the prestressed spring 20 can be seen in FIG. 3: the term "prestressed" should be understood in the sense that the spring is compressed prior to be placed between the above-mentioned points 40 and 45. It will easily be understood that the resilient reaction R1 of the spring provides a moment about the pivot axis 35 tending to keep the locking tooth 15 of the ratchet 10 engaged in the notch 50*a* of the moving component 30.

When under these conditions a force F is applied to the moving component 30 (cf. FIG. 4*a*), the moving component moves leftwards so that the above-mentioned vertical segment 31 of its notch 50*a* (constituting the abutment for the finger 15 of the ratchet 10 and against which this finger is engaged when in the corresponding stable equilibrium configuration) moves away from the finger 15 when the motion of the moving component 30 begins to reverse, such that the horizontal segment 32 of the notch 50*a* in the moving component 30 slides leftwards over the tip of the finger 15. Throughout the entire duration of this relative sliding with the finger 15 rubbing on the horizontal segment 32 of the notch 50*a* (cf. FIG. 4*b*), the ratchet 10 remains stationary until the sloping portion 33 of the notch 50*a* engages the finger 15 of the ratchet, thereby enabling the force F which is acting on the moving component 30 to exert a moment about the pivot axis 35 of the ratchet 10 which is greater than the moment exerted by the resilient reaction R1 about said axis 35. As soon as this condition is reached, the moving component 30 causes the ratchet 10 to switch over so that it can rotate in the direction indicated by the arrow in FIG. 4*c* until it takes up a configuration in which the resilient reaction R1 passes through the pivot axis, i.e. until the moment of this reaction becomes zero. This configuration which is the configuration shown in above-mentioned FIG. 4*c*, defines the "switchover" position of the locking device 100 and corresponds to a typical function of this device in the sense that the means which co-operate to achieve this function are the characteristic means of a device of the invention. It will easily be understood that once the ratchet has reached the switchover position shown in FIG. 4*c*, further leftwards sliding of the moving component 30 rotates the ratchet 10 further (and this happens suddenly, cf. FIG. 8) about its pivot axis in the direction of the arrow shown in FIG. 4*c* such that the moment of the resilient reaction R1 of the spring 20 reverses, as can be seen in above-mentioned FIG. 4*d*. Under these circumstances, the finger 15 of the ratchet 10 is disengaged from the bottom of the notch 50*a* whereas the bottom of the symmetrical notch 50*b* in the moving component 30 comes into sliding contact with the second finger 25 of the ratchet 10, which finger is symmetrically disposed relative to the first finger 15, and such that such sliding contact continues until the vertical segment 31 of the notch 50*b* comes into abutment with the finger 25, as shown in FIG. 4*e*. Under these conditions, the moving component 30 is in its second extreme stop position IIa, and the ratchet 10 is in its second stable equilibrium position IIb.

Starting from this final configuration shown in FIG. 4*e*, reversing the direction of the force F, i.e. applying the force F′ of FIG. 3, causes the process described above with reference to FIGS. 4*a* to 4*e* to take place in reverse, thereby enabling the moving component 30 to reach its first extreme stop position Ia, which corresponds to the first stable equilibrium position Ib of the ratchet 10, as shown in FIG. 4*a*.

The above-specified FIGS. 4*a* to 4*e* are deduced using computer simulation to verify the validity of the concept on which the ratchet-locking device of the invention is based and also to display the dynamic behavior of the device.

Figure 4A:
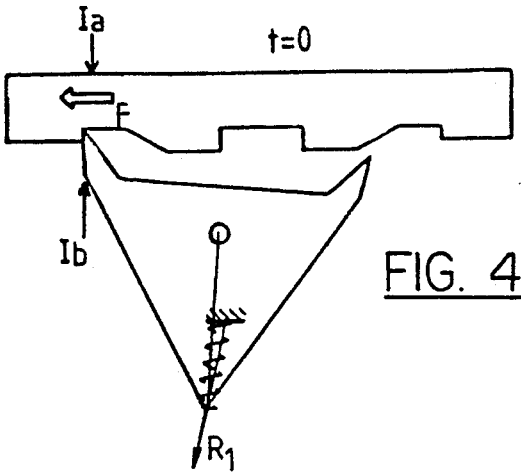
Figure 4B:
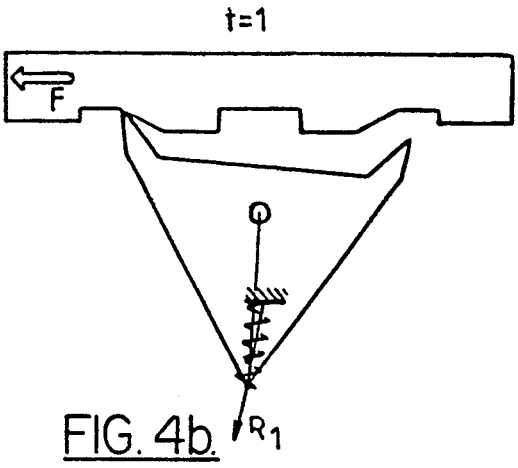
Figure 4C:
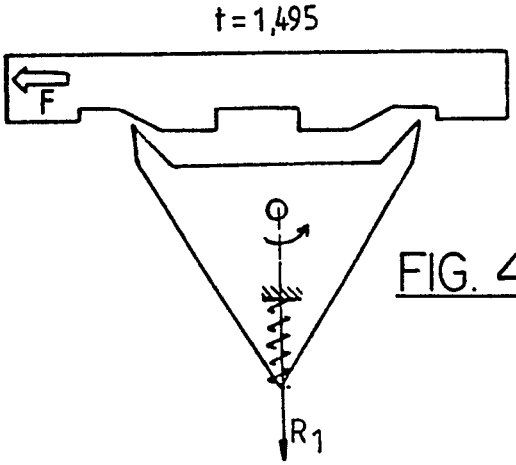
Figure 4D:
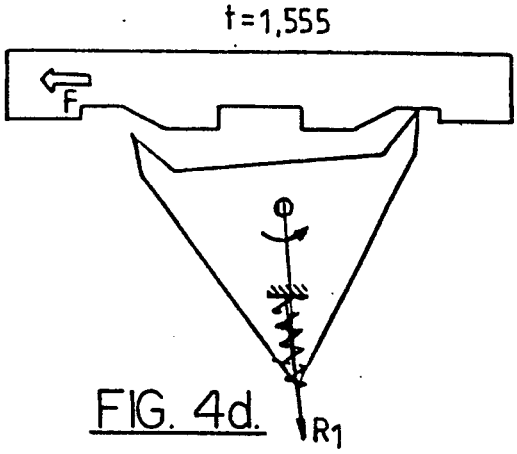
Figure 4E:
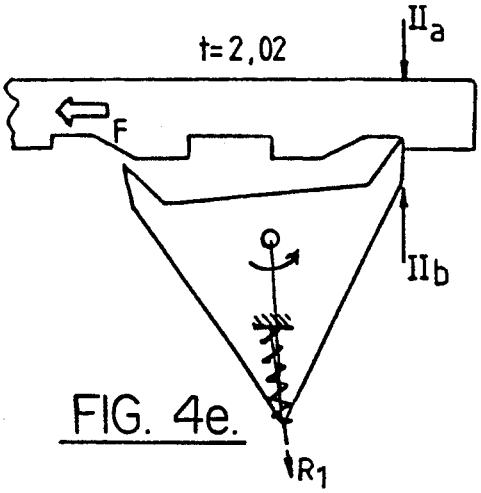

In order to obtain a better understanding of the figures, the positions of the device shown in FIGS. 4*a* to 4*e* should be put into correspondence with the time taken: i.e. FIG. 4*a* which corresponds to the initial configuration occurs at time t=0 sec, FIG. 4*b* corresponds to time t=1 sec, FIG. 4*c* corresponds to time t=1.495 sec, FIG. 4*d* corresponds to time t=1.555 sec, and FIG. 4*e* corresponds to time t=2.02 sec.

Figure 8:
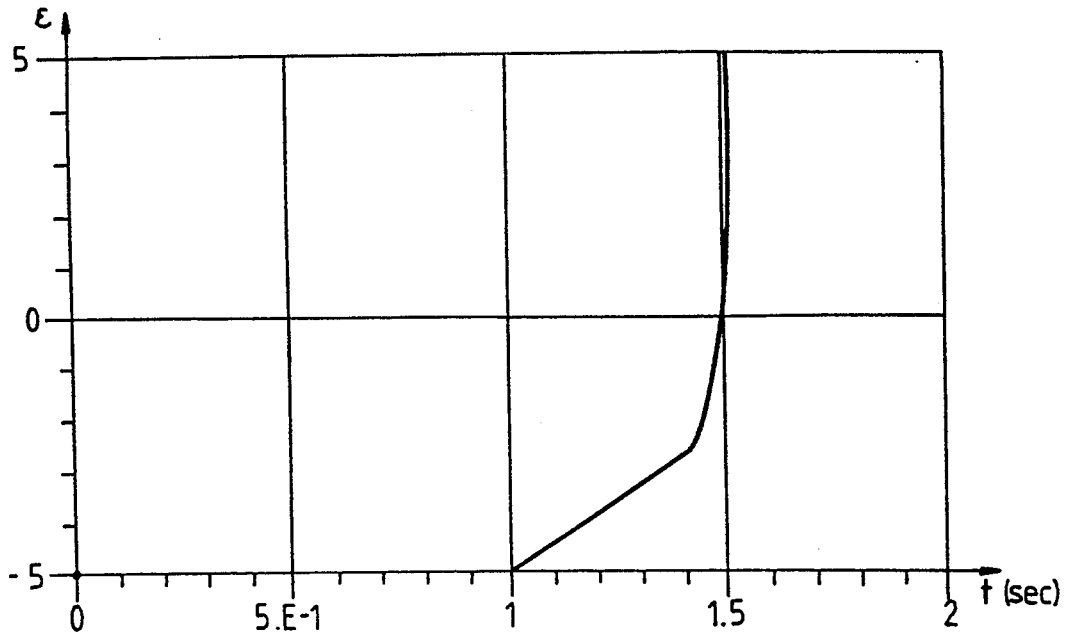
Figure 9:
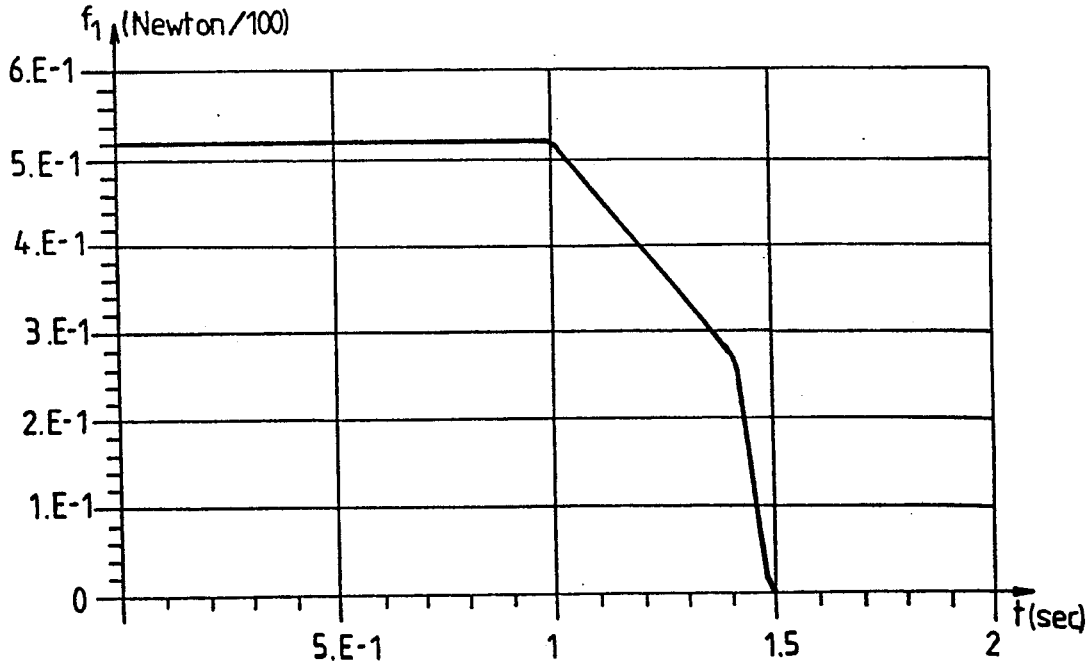
Figure 10:
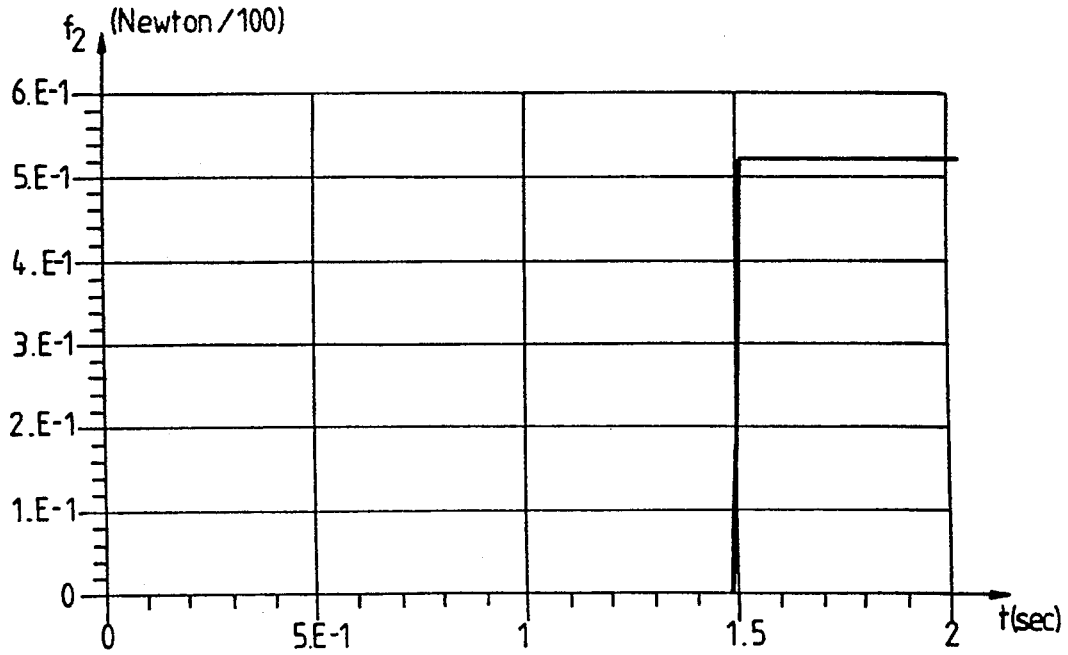
Figure 11:
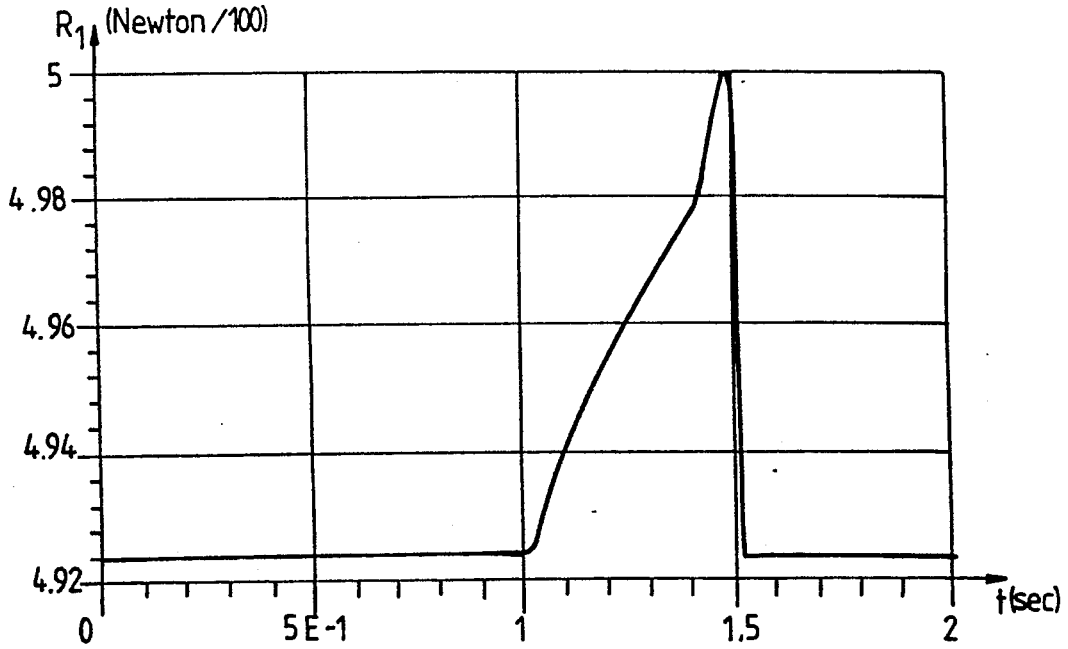

Under these circumstances, FIG. 8 shows the rotation $\epsilon$ of the ratchet as a function of time, with its angle of rotation being defined by the axis of the ratchet relative to the vertical v which is assumed to be downwards (see FIG. 3). FIG. 9 shows the way the contact force $f_1$ between the moving component 30 and the finger 15 of the ratchet 10 varies as a function of time, whereas FIG. 10 shows how the contact force $f_2$ between the moving component 30 and the finger 25 of the ratchet 10 varies as a function of time, with FIG. 11 showing how the resilient reaction R1 of the spring 20 varies as a function of time during displacement of the moving component 30 from one extreme stop position to the other. In the graphs of FIGS. 8 to 11 the unit of force is newtons/100.

The following considerations are useful in constructing the locking device 100 shown in FIG. 3.

To this end, the following definitions are given:

"active end": this is a zone in the profile of the notch along which the moving component comes into contact with the ratchet after the ratchet has switched over and until the moving component is locked; and "locked end": this is a point on the locking device where the moving component and the ratchet are engaged so as to be able to support loads.

Given these definitions, it is clear that a locked end is also an active end, whereas the opposite is not necessarily true.

The following symbols are used in the following equations (cf. FIG. 3):

s=the stroke of the moving component;

x'=the displacement of the moving component that causes the locking ratchet to switch over;

x''=the displacement of the moving component that is required for finishing its stroke after the locking ratchet has switched over;

v=the velocity of the moving component;

T=the time required to switch over the locking ratchet;

d=the distance measured on the locking ratchet between its points of contact with the moving component;

l=the distance measured on the moving component between its points of contact with the locking ratchet; and b=the distance measured on the moving component between the points thereof which correspond to the locking ratchet switching over.

The following equations are fundamental mathematical equations relating the above-defined variables and useful in understanding the operation of the device of the invention (cf. FIG. 3, once more).

The stroke s of the moving component is given by:

$$s=x'+v.T+x'' \quad (1)$$

The following geometrical relationship is also valid:

$$l=x'+b+x'' \quad (2)$$

In addition, for the switchover of the ratchet to be effective, it is necessary that:

$$b\leqq d+v.T \quad (3)$$

To satisfy conditions of symmetry:

$$x''\leqq x' \quad (4)$$

By way of example, it may be assumed that:

$$v.T=0 \quad (5)$$

(this condition is equivalent to assuming that the velocity of the moving component is high or that the switchover takes place very quickly); and $$x''=x' \quad (6)$$

(this is a limit condition).

Under these circumstances, the above equations can be used to obtain:

$$s=2.x'$$

$$l=2.x'+b$$

which gives:

$$s=l-b \quad (7)$$

This means that once l has been fixed, b must be small in order to obtain a long stroke. It also follows that d must also be small, but that it must always be greater than b so that equation (3) is satisfied.

When these conditions are satisfied, the locking device appears as shown in FIG. 5 where the same numerical references are used as in FIG. 3 except that they include an asterisk, so as to distinguish these two figures.

Equation (1) shows that it is possible to obtain long strokes by acting on the "dynamic" term v.T. In order to make this term large, the ratchet must switch over slowly and/or the moving component must move at high velocity. The first condition means that careful account must be taken of the dynamic behavior of the ratchet, whereas the second condition means that account must be taken of limitations that are conventional in the construction of cams and their associated cam followers.

The presence of the "dynamic" term v.T in some of the equations written down above also means that effective operation of the device depends on how the moving component is activated. When the moving component moves at a velocity which is higher than its nominal velocity, there is a risk of contact being lost between the moving component and the locking ratchet due to the ratchet bouncing, and this corresponds to a problem that is well known to persons skilled in the art of designing cams and their associated cam followers.

In practice, the construction of a locking device of the invention begins by defining the following five points:

1) the shape and the geometry of the locking ratchet.
2) the stroke of the moving component.

3) the initial position of the locking ratchet relative to the moving component.
4) the profile of the moving component.

Figure 7:
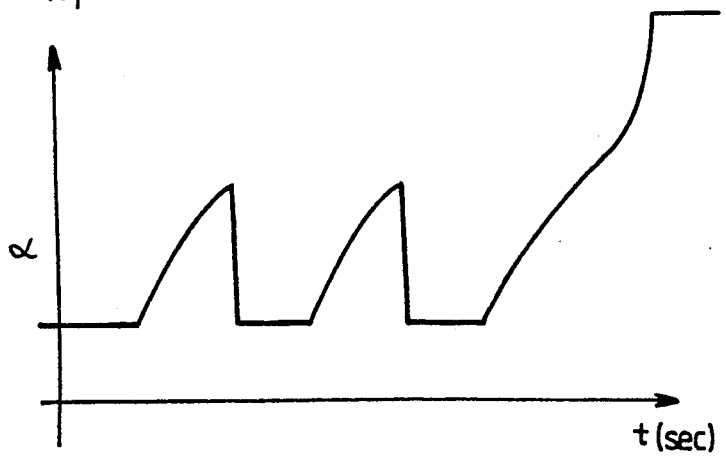

In this context, it should be observed that intermediate notches such a 50 and 51 may also be provided as shown in FIG. 6, however the presence of additional notches makes the locking device one-directional with respect to the intermediate positions only inbetween the above-mentioned extreme stop positions. If the additional notches are well designed, they have no effect on the switching over of the locking ratchet. This is illustrated by the graph of FIG. 7 which shows rotation $\alpha$ of the ratchet in FIG. 6 as a function of time and in which the first two portions of the curve correspond to the first two notches of the moving component having sloping segments of insufficient height to cause the ratchet to switch over, while nevertheless enabling it to rock a little, with this being repeated under the same conditions when going from the first notch to the second notch, whereas the third portion of the graph corresponds to the third notch of the moving component whose sloping segment is of sufficient height to cause the ratchet not only to rotate, but also to switch over.

By generalizing the circumstances shown in FIG. 6, it can thus be said that the moving component may include n intermediate notches (such as 51 and 52) between the first and second end notches, with the first (n−1) intermediate notches (immediately following each end notch), such as 51, having a composite profile such that the sloping section (like the sloping section of the composite profile of the corresponding end notch) has a height that is less than the height of the sloping segment of the n-th intermediate notch (which is the notch furthest from the corresponding end notch), such as 52, such that the ratchet switches over only when the corresponding locking finger engages the sloping segment of the n-th abovementioned intermediate notch during the motion of the moving component. Other than items which are not common to FIGS. 6 and 3, i.e. the intermediate notches 51 and 52, the remaining common items are designated in both of them using the same numerical references plus two asterisks in FIG. 6 in order to distinguish them from FIG. 3.

5) The shape of the sloping segments of the notches provided on the moving component which make it possible to act on the locking ratchet in such a manner as to bring it into its switchover position as mentioned above.

Points 1) and 3) serve to determine d.

Points 3), 4), and 5) contribute to determining x', i.e. the displacement of the moving component which is necessary to cause the locking ratchet to switch over. In some applications, it may be necessary to keep x' very small.

Naturally, appropriate measures must be taken to avoid interference taking place between the locking ratchet and the moving component at the non-active end thereof while the moving component is moving (where the non-active end corresponds to the end of the moving component which is not in contact with the locking ratchet, and which should not come into engagement therewith).

FIG. 12 is a diagram of another embodiment of the ratchet locking device of the invention which differs from the device shown in FIG. 3 in that the moving component is circular instead of being rectilinear. It is constituted by a ratchet wheel 70 which is suitable for rotating about a shaft 85 and which includes substantially rectangular teeth 95 separated by notches 150 which are likewise substantially rectangular. The ratchet wheel co-operates with a ratchet 60 which is likewise symmetrical about a plane passing through its pivot axis 55, which axis is fixed to a support frame. The ratchet 60 has two symmetrical fingers 65 and 95 carried by two arms 61 and 62 and designed to come into abutment or into sliding contact respectively against one or other of the shoulders 71 and 72 delimiting each of the notches 150 between pairs of consecutive teeth 75. When a finger, e.g. 65, is in the position shown in FIG. 13, it is in abutment against the shoulder 71 of the notch 150 via a face 63 so as to engage the tooth 75 of the rack 70 and so as to be suitable for coming into sliding contact via its face 64 with the shoulder 72 of the notch 150 when the ratchet wheel 70 is caused to move in the direction represented by the arrow in FIG. 13, i.e. clockwise. The relative disposition between a notch on the rack 70 and a finger of the ratchet 60 engaged therein is illustrated in FIG. 14 which is view along arrow XIV.

The configuration in which the ratchet 60 is shown in engagement with a tooth of the ratchet wheel 70 is made stable by means of a spring 200 which is mounted in a prestressed condition between the support frame 90 for the device 500 (with the frame being represented in FIG. 12 in the same way as it is represented in the preceding figures) and a point on the ratchet 60 which is situated in the plane of symmetry of the ratchet, such as the point 80 (which corresponds to the point 40 of the ratchet 10 of the device 100 shown in FIG. 3).

The direction of the resilient reaction of the prestressed spring 200 is shown in FIG. 12 by arrow R2.

The operation of the device 500 is practically identical to that of the device 100 apart from the fact that in the first case the motion of the moving components is linear whereas in the second case it is circular.

It is instructive to examine the thought process whereby the rectilinear ratchet locking device 100 can be converted into the circular ratchet locking device 500. This process is illustrated diagrammatically in FIGS. 15 to 17.

FIG. 15 shows a locking device A that may be thought of as being obtained by deforming a rectilinear moving component so as to make it circular in shape. The resulting ratchet wheel 9 has eight teeth 3 which are diametrically opposite one another in pairs. These eight teeth are thus disposed in two groups of four teeth each, with the groups being separated by diametrically opposite projections 1 and 2. These projections are designed to bear against two studs 4 and 6 projecting from the ratchet 12. The ratchet 12 is disposed beneath the ratchet wheel 9 and only portions thereof are visible in FIG. 15, with the remainder thereof being represented by dashed lines.

The pivot axes of the ratchet wheel 9 and of the ratchet 12 are designated by reference numerals 5 and 7 respectively.

The spring which keeps the ratchet 12 engaged with a tooth 3 on the ratchet wheel 9, in particular in the position shown in FIG. 15, is mounted in a prestressed condition between the axis of rotation 5 of the ratchet wheel 9 and a point 13 on the ratchet 12.

The locking device shown in FIG. 15 corresponds to a definition designed essentially for the purpose of providing a configuration capable of defining optimum geometry for the components of the locking device comprising a ratchet and a ratchet wheel. More precisely, the configuration A of this device makes it possible to establish that the possibility of obtaining effective switchover of the ratchet 12 depends strongly on the choice of construction parameters such as the spacing between the axes of the ratchet and the ratchet wheel or the height of the teeth on the ratchet wheel.

However, this configuration shows the difficulty of avoiding interference between the studs on the ratchet and the teeth on the ratchet wheel. Further, this first test as shown in FIG. 15 shows that the preferred configuration of the ratchet wheel is constituted by a wheel which is symmetrical, and that led to this pre-project being abandoned. FIG. 16 shows a second pre-project B for the ratchet and ratchet wheel device, derived from the configuration A with the purpose of obtaining a simpler design for the ratchet wheel. In this case, the ratchet switches over under actuation from studs 16 and 17 fixed to the ratchet wheel and not by a projection of the ratchet wheel. FIG. 16 shows the positions of the components of the locking device at the beginning of ratchet wheel rotation, (i.e. when the stud 6 of the ratchet is engaged with corresponding projection 11 of the ratchet wheel). This ratchet is represented diagrammatically as in FIG. 15, by lines connecting the studs 4 and 6 to the pivot axis 7. The small number of teeth shown in FIG. 16 (and also in FIG. 15) is to simplify the drawing.

A detailed analysis of this second pre-project B shows that it is easier to construct than the first: the geometrical characteristics of the components of the locking device can be varied relatively widely without interfering with ratchet switchover. In addition, it is very easy to prevent interference taking place between the components during switchover. FIG. 17 corresponds to the device shown in FIG. 16 and is given to show the ratchet in the positions it occupies prior to switching over (solid lines) and after switching over (dashed lines).

That said, it is clear that the configuration in FIG. 12 corresponds to a ratchet wheel which is fully symmetrical by adopting notches that are rectangular, i.e. rectangular teeth, to replace a wheel having a conventional saw-tooth profile (circular). A rectangular tooth is suitable for locking ratchet wheel rotation in either direction. The direction in which the ratchet wheel can rotate is determined by the position of the ratchet, e.g. by which side thereof is engaged with the ratchet wheel, in accordance with considerations described above.

In the case shown in FIG. 12 (corresponding to the final design adopted for the circular ratchet and ratchet wheel locking device of the invention based on the trials shown in FIGS. 15 and 16–17), it can be seen that a single stud 73 projects from the surface of the ratchet wheel for the purpose of causing the locking ratchet 60 to switch over, thereby further simplifying the structure of the device.

In addition, it should also be observed that with the device shown in FIG. 12, so long as it is designed carefully, the ratchet wheel may rotate between two consecutive switchover positions through very nearly one complete turn (360°). Under these conditions, this means that to obtain switchover of the locking ratchet, only a very small rotation is required (5° to 10°), thereby defining an angle $\alpha 0$ that may be referred to as the "sharp switchover angle" (i.e. sudden switchover) for the ratchet.

If the "efficiency" of the ratchet and ratchet wheel locking device is defined as follows:

$$\eta = 1 - \alpha 0/360^\circ$$

then this efficiency may reach a value of 99.2% which may be compared with the value of 90% that corresponds to the rectilinear locking device shown in FIGS. 3 and 4.

The simplicity of the structural design of the locking device shown in FIG. 12 means that it is very simple to build. Various structural parameters may be selected over wide ranges of values without having any influence on the ability of the ratchet to switchover, thereby making it possible to optimize various characteristics of the device such as its "efficiency" (as defined above) and its compactness. It should also be observed that adopting rectilinear notches for the ratchet wheel, such as the notches referenced 150 in FIG. 12, constitutes a novel characteristic for ratchet and ratchet wheel locking devices to be added to the automatic switchover characteristic of the ratchet from one locking position to the other. In conventional one-directional ratchet and ratchet wheel locking devices it is usual practice for the ratchet wheels to have teeth which together define a saw-tooth profile or teeth which are not symmetrical.

It should be specified that the ratchet and ratchet wheel locking device shown in FIG. 12 should not be confused with the escapements used in clocks, even if the ratchet of the device of the invention is to some extent similar in configuration to the pallet of a clock. Such a comparison can easily be performed with reference to FIG. 18 which shows a conventional escapement. The escapement of a clock seeks essentially to control the motion of a gear system and it delivers energy thereto from a suitable source of energy (e.g. constituted by a spring or a falling weight), by repeated reciprocating engagement between the escapement wheel and the pallet in two different positions. The ratchet of the locking device of the invention operates quite differently as can be seen from the above description and, in addition, an escapement wheel rotates in one direction only.

The present invention thus provides a ratchet type locking device which unlocks automatically and which presents the following two properties:

the ability to unlock the active end of the moving component; and simultaneously, the ability to lock the non-active end of the moving component automatically.

As already mentioned above, when these two simultaneous conditions occur, the ratchet is said to "switch over" and this takes place without any need for external activation of the locking ratchet, and it takes place only when the moving component has reached a certain position enabling it to unlock the ratchet automatically under the action of the load applied to the moving component.

Another remarkable property of the device of the invention is that there is no need to reposition the locking ratchet when motion is reversed, and this is due to the symmetrical configuration of the device which has two active ways of switching over. These properties clearly distinguish the automatic unlocking device of the invention from similar devices in the prior art which either require external action on the locking ratchet to reverse the motion of the moving component or else they require the ratchet to be repositioned during each cycle.

To sum up the above, it should be emphasized that the property held in common by the two devices of the invention shown in FIGS. 3 and 12 respectively is that they are both automatically unlockable. And in addition:

i) the device shown in FIG. 3 has a symmetrical ratchet with two stable equilibrium positions which (together with the automatic unlocking) provide characteristics that are novel for rectilinear (or linear) locking devices; and ii) in the device of FIG. 12, there is a ratchet wheel which is symmetrical having notches (and teeth) that are substantially rectangular, thereby making it two-directional, which (together with the automatic unlocking) corresponds to novel characteristics for circular locking devices.

There are numerous applications for the device of the invention. Some such applications are given below by way of example.

a) Space applications:

controlling the motion of wheels for optical filters in a telescope;

fixing connectors to docking surfaces of space vehicles; and mechanisms for deploying panels of solar cells.

b) Earth applications:

making certain types of screwdriver (using the ratchet and ratchet wheel embodiment shown in FIG. 12), thereby making it possible, in alternation, to tighter screws only or to loosen screws only through a certain number of revolutions (with this particular type of tool also being suitable for use in extravehicular activities (EVA)), and also to obtain automatic reversal of tool operation during tapping operations;

implementing automatic tool dispensers in automatic machine tools under computer control;

making position-detecting instruments: this is made possible by the fact that when the oscillations of the locking ratchet caused by the composite sloping profile of the moving component of the device shown in FIG. 6 are recorded as a function of time, it is possible to detect the intermediate positions of the moving component (cf. also FIG. 7); and making instruments for detecting the reversal of the motion of the moving component, which is made possible using the moving component configuration shown in FIG. 3 by recording successive oscillations of the locking ratchet as a function of time.

As can be seen from the above, the invention is not limited in any way to those embodiments or implementations that have been described in greater detail. On the contrary, it extends to any variant that may occur to the person skilled in the art without going beyond the scope of the present invention.

In particular, it should be observed that the overall configurations of the ratchet and the moving component in the device of the invention are drawn somewhat arbitrarily. It should be understand that other overall configurations may be adopted without going beyond the present invention, providing the structural details at the interface between the components of the device remain unchanged.

Further, it should be specified that the term "ratchet" has been used in the description of the present invention both in its general meaning of "locking means" without any limitation whatsoever on the overall configuration, and also to simplify the drafting of the description of the device of the invention.

I claim:

1. A locking device (100; 500) comprising the following components:

a moving component (30; 70) for moving between first and second extreme stop positions (Ia, IIa), and including at least a first notch and a second notch (50*a*, 50*b*; 150) formed in the moving component (30; 70) symmetrically about an axis of symmetry thereof and in positions corresponding to its extreme stop positions (Ia, IIa), with the bottoms of said notches having sections of appropriate profile (31-32-33; 71-150-72);

a ratchet (10; 60) pivoting between a first stable equilibrium position and a second stable equilibrium position (Ib, IIb), which positions correspond to locking the moving component (30; 70) in its above-mentioned first and second stop positions (Ia, IIa) respectively, which pivoting ratchet (10; 60) is symmetrical about a plane including its pivot axis (35; 55) and including on opposite sides of said plane a first locking finger (15, 65) and a second locking finger (25; 75) each for engaging in stable manner under the action of a load (F) acting on the moving component (30; 70) in a corresponding one of the notches (50*a*, 50*b*; 150) formed in the moving component, in correspondence with said extreme stop positions (Ia, IIa), and until a load (F') is applied to the moving component (30; 70) in the opposite direction; and a spring (20; 200) mounted in a prestressed condition so that its resilient reaction (R1; R2) establishes a moment about the pivot axis (35; 55) of the ratchet (10; 60), which moment acts in such a direction as to maintain said ratchet in its first or second stable equilibrium position (Ib, IIb), thereby locking the moving component (30; 70) in its first or second extreme stop position (Ia, IIa), respectively, the spring (20; 200) being mounted in such a manner that for a given resilient reaction (R1; R2) thereof, the distance of said reaction relative to the pivot axis (35; 55) of the ratchet (10; 60) in either of the two locking positions (Ib, IIb) is such that the ratchet (10; 60) is unlocked by the application of the smallest load that may be applied to the moving component (30; 70) in the direction for moving towards the other extreme stop position (IIa, Ia), such a ratchet-unlocking load (10; 60) causing the ratchet to pivot towards a "switchover" position in which the moment of its resilient reaction (R1; R2) relative to the pivot axis (35; 55) of the ratchet (10; 60) becomes zero such that final switching over thereof to the other locking position (IIb, Ib) for locking the moving component (30; 70) in said other extreme stop position (Ia, Ib) takes place automatically solely under drive from the above-mentioned ratchet-unlocking load.

2. A device according to claim 1, characterized in that the moving component (30) is rectilinear.

3. A device according to claim 2, characterized in that each of said two notches (50*a*, 50*b*) of the moving component (30) which correspond to its extreme stop positions (Ia, IIa) and which are symmetrically disposed about a plane of symmetry of said moving component has a composite profile constituted by a succession of three segments, comprising a substantially vertical first segment (31) constituting an abutment against which a corresponding finger (15, 25) of the ratchet (10) comes into engagement, a second segment (32) which is horizontal and designed to slide over said finger at the beginning of reversal in the motion of the moving component (30), and a third segment (33) which slopes and which is designed to engage said finger to cause the ratchet (10) to switch over in co-operation with said spring.

4. A device according to claim 1, characterized in that the moving component is circular and is constituted by a symmetrical ratchet wheel (70).

5. A device according to claim 4, characterized in that the ratchet wheel (70) has substantially rectangular notches (150) uniformly distributed around its periphery and each lying between two consecutive teeth (95), which are likewise substantially rectangular.

6. A device according to claim 4 or 5, characterized in that the ratchet wheel (70) has a single stud (73) on its surface projecting from said surface and designed to switch over the ratchet (60) when the motion of the ratchet wheel is reversed.

7. A device according to claim 3, characterized in that the moving component (30) includes n intermediate notches (51, 52) between the first and second end notches (50**a, 50**b), and in that the (n − 1) first intermediate notches (51) immediately after each end notch (50**a, 50**b) have a composite profile whose sloping segment has, like the sloping segment of said composite profile of the corresponding end notch, a height which is less than the height of the sloping segment of the n-th intermediate notch (52), such that the ratchet (10**) is switched over solely when the corresponding locking finger (15**, 25**) engages the sloping segment of said n-th intermediate notch (52) during the motion of the moving element (30****).

* * * * *